US006336336B1

(12) United States Patent
Kawaminami et al.

(10) Patent No.: US 6,336,336 B1
(45) Date of Patent: Jan. 8, 2002

(54) ROTARY PISTON COMPRESSOR AND REFRIGERATING EQUIPMENT

(75) Inventors: Shigeya Kawaminami; Tatsuya Wakana, both of Oohira; Kenichi Oshima, Iwafune; Minoru Oki, Oyama; Tatsuo Horie, Oohira, all of (JP)

(73) Assignee: Hitachi, Ltd., Tokyo (JP)

( * ) Notice: Subject to any disclaimer, the term of this patent is extended or adjusted under 35 U.S.C. 154(b) by 0 days.

(21) Appl. No.: 09/531,492

(22) Filed: Mar. 20, 2000

(51) Int. Cl.[7] ..... F25B 49/00
(52) U.S. Cl. ..... 62/196.3
(58) Field of Search ..... 62/196.3, 196.1, 62/190; 417/297; 418/14

(56) References Cited

U.S. PATENT DOCUMENTS 4,459,817 A * 7/1984 Inagaki et al. ..... 62/196.3
4,474,542 A * 10/1984 Kato et al. ..... 417/270
4,727,724 A * 3/1988 Intichar et al. ..... 62/55.5
5,511,389 A * 4/1996 Bush et al. ..... 62/505
5,540,199 A * 7/1996 Penn ..... 123/243
5,548,973 A * 8/1996 Komine et al. ..... 62/469
5,572,882 A * 11/1996 Schafer ..... 62/402
5,595,067 A * 1/1997 Maness ..... 62/401
5,950,452 A * 9/1999 Sakitani et al. ..... 62/498
5,996,355 A * 12/1999 Jirnov et al. ..... 62/87
6,237,351 B1 * 5/2001 Itoh et al. ..... 62/196.3

FOREIGN PATENT DOCUMENTS

JP 07158574 6/1995

* cited by examiner

*Primary Examiner*—Teresa Walberg
*Assistant Examiner*—Daniel Robinson
(74) *Attorney, Agent, or Firm*—Antonelli, Terry, Stout & Kraus, LLP

(57) ABSTRACT

In a rotary piston compressor and refrigerating equipment employing the rotary piston compressor, the interior of a cylinder chamber is divided into a suction chamber and a compression chamber by a vane which is formed unitarily with a roller. The rotary bushing on the compression chamber side which supports the vane is so arranged as to be moved with a specific pressure, so that a communicating passage for communication between the compression chamber and a space on the discharge side will be opened and closed with the movement of the rotary bushing on the compression chamber side.

7 Claims, 8 Drawing Sheets

ROTARY PISTON COMPRESSOR AND REFRIGERATING EQUIPMENT

BACKGROUND OF THE INVENTION

This invention relates to a rotary piston compressor and refrigerating equipment; and, more particularly, the invention is directed to a rotary piston compressor in which a rotor and a vane are unitarily formed, and to refrigerating equipment using the rotary piston compressor, such as an air conditioner, a refrigerator, and a refrigerating device.

A conventional rotary piston compressor is provided with a cylinder which forms a cylinder chamber and a bushing housing chamber communicating with this cylinder chamber, a piston disposed in the cylinder chamber, and a rotary bushing disposed in the bushing housing chamber. The piston unitarily has a roller which rotates in the cylinder chamber, and a vane which, together with the roller, divides the interior of the cylinder chamber into a suction chamber and a compression chamber.

The vane is extended into the bushing housing chamber, so that the rotary bushing is divided into a rotary bushing on the compression chamber side and another rotary bushing on the suction chamber side on both sides of the vane.

In the rotary piston compressor, the rotary bushing rotates in the bushing housing chamber with the rotation of the roller to absorb rotation and axial motion of the vane, thereby increasing the volume of the suction chamber and decreasing the volume of the compression chamber. In this manner the refrigerant is drawn into the suction chamber and compressed in the compression chamber, being discharged out of the cylinder.

A prior art rotary piston compressor has been disclosed in, for instance, JP-A No. H7-158574.

The prior art rotary piston compressor, however, has a drawback in that, when drawn into the cylinder chamber immediately after starting, a liquid refrigerant or a wet refrigerant is subject to volume expansion the instant when the refrigerant is drawn into the cylinder chamber, or to volume contraction when the refrigerant is still in an almost liquid state. Since, in this case, the rotary piston roller and vane are unitarily formed, the refrigerant is likely to be excessively compressed.

Therefore, it has been proposed to form a dead space communicating with the compression chamber, whereby transient overcompression occurring at the time of starting will be alleviated. However, during routine operation, the presence of the dead space allows a high-pressure gas to remain within the cylinder chamber after the end of the discharge stroke, causing re-expansion of the refrigerant in the following stroke and accordingly resulting in a pressure loss at the time of suction and a lowering of the refrigerating capacity.

SUMMARY OF THE INVENTION

It is therefore an object of this invention to provide a reliable, high-performance rotary piston compressor and refrigerating equipment which are of a simple configuration and are capable of preventing overcompression without deterioration of performance during routine operation, and which are also capable of preventing re-expansion of the refrigerant after the completion of the discharge process.

For attaining the above-described object, according to a first feature of this invention, a rotary piston compressor is provided with a cylinder which forms a cylinder chamber and a bushing housing chamber communicating with this cylinder chamber, a piston disposed in the cylinder chamber, and a rotary bushing disposed in the bushing housing chamber. The piston is unitarily formed with a roller which rotates in the cylinder chamber, and a vane which, together with the roller, divides the interior of the cylinder chamber into a suction chamber and a compression chamber. The vane is extended into the bushing housing chamber, so that the rotary bushing is separated into a rotary bushing on the compression chamber side and another rotary bushing on the suction chamber side on both sides of the vane. The rotary bushing on the compression chamber side is disposed so as to move away from the cylinder chamber when the compression chamber pressure has been not less than a specific pressure, and also to move toward the cylinder chamber when the compression chamber pressure has decreased to not more than a specific pressure. With the movement of the rotary bushing on the compression chamber side, a communicating passage for communication between the compression chamber and the space on the discharge side outside of the cylinder is opened and closed.

According to a second feature of this invention, the rotary bushing on the compression chamber side has a portion facing the compression chamber and a portion facing the high discharge pressure side, and is so arranged as to move away from the cylinder chamber when the resultant of the load applied to the portion facing the compression chamber and the load applied to the portion facing the high discharge pressure side is not less than the specific value, and to move toward the cylinder chamber when the resultant has decreased to not more than the specific value. The communicating passage for communication between the compression chamber and the space on the discharge side outside of the cylinder therefore is opened and closed with the movement of the rotary bushing on the compression chamber side.

According to a third feature of this invention, the rotary piston compressor is provided with a cylinder including a cylinder chamber, a bushing housing chamber connected to the cylinder chamber, and a oil-supply pump chamber connected to the bushing housing chamber. The oil-supply pump chamber communicates with the high discharge pressure side; the vane is extended from the bushing housing chamber to the oil-supply pump chamber, which therefore is provided with the pumping function by the motion of the vane; the rotary bushing on the compression chamber side has a portion facing the compression chamber and a portion facing the oil-supply pump chamber, and moves away from the cylinder chamber when the resultant of the load applied to the portion facing the compression chamber and the load applied to the portion facing the oil-supply pump chamber is not less than a specific value, and moves toward the cylinder chamber when the resultant has decreased to not more than the specific value.

According to a fourth feature of this invention, the compression chamber side of the bushing housing bore which forms the cylinder chamber is comprised of a circular portion on the cylinder chamber side, an intermediate straight portion, and a circular portion on the opposite side of the cylinder chamber as viewed from the vicinity of the cylinder chamber.

According to a fifth feature of this invention, the bushing housing bore defining the cylinder chamber asymmetrically forms the suction chamber side and the compression chamber side. The rotary bushing on the suction chamber side is so formed as to have approximately the same external semicircular shape as the semicircular portion on the suction chamber side of the bushing housing bore.

A sixth feature of this invention resides in the fact that the intermediate straight portion spreads outward.

A seventh feature of this invention resides in the fact that the rotary bushing on the compression chamber side moves away from the cylinder chamber when the compression chamber pressure has been not less than the specific pressure in the discharge stroke of the compressor, and moves toward the cylinder chamber when the compression chamber pressure has lowered to not more than the specific pressure after the completion of the discharge process of the compressor.

An eighth feature of this invention resides in the fact that a refrigerating cycle is formed by connecting a rotary piston compressor, a condenser, a pressure reducing device, an evaporator, and a receiver tank by means of a piping. The rotary piston compressor is provided with a cylinder which forms a cylinder chamber and a bushing housing chamber communicating with this cylinder chamber, a piston disposed in the cylinder chamber, and a rotary bushing disposed in the bushing housing chamber. The piston unitarily has a roller which rotates in the cylinder chamber, and a vane which, together with the roller, divides the interior of the cylinder chamber into a suction chamber and a compression chamber. The suction chamber is connected to a piping from the receiver tank. The vane is extended into the bushing housing chamber. The rotary bushing is so arranged as to be separated into a rotary bushing on the compression chamber side and another rotary bushing on the suction chamber side on both sides of the vane. Furthermore, the rotary bushing has a portion facing the compression chamber and a portion facing the high discharge pressure side, and is so arranged as to move away from the cylinder chamber when the resultant of the load applied to the portion facing the compression chamber and the load applied to the portion facing the high discharge pressure side has been not less than a specific value, and to move toward the cylinder chamber when the resultant has decreased to not more than the specific value. The communicating passage for providing communication between the compression chamber and the space on the discharge side outside of the cylinder therefore is opened and closed with the movement of the rotary bushing on the compression chamber side.

According to a ninth feature of this invention, a refrigerating cycle is formed by connecting a rotary piston compressor, a condenser, a pressure reducing device, an evaporator, and a receiver tank by means of a piping. The rotary piston compressor is provided with a cylinder which forms a cylinder chamber and a bushing housing chamber communicating with this cylinder chamber, a piston disposed in the cylinder chamber, and a rotary bushing disposed in the bushing housing chamber. The compression chamber side of the bushing housing bore defining the cylinder chamber is comprised of a circular portion on the cylinder chamber side, an intermediate straight portion, and a circular portion on the opposite side of the cylinder chamber as viewed from the vicinity of the cylinder chamber; the intermediate straight portion being designed to spread outward.

Other objects, features and advantages of this invention will be apparent from the following detailed description taken in connection with the accompanying drawings.

DESCRIPTION OF THE PREFERRED EMBODIMENTS

Each embodiment of this invention will hereinafter be described with reference to the accompanying drawings.

Figure 1:
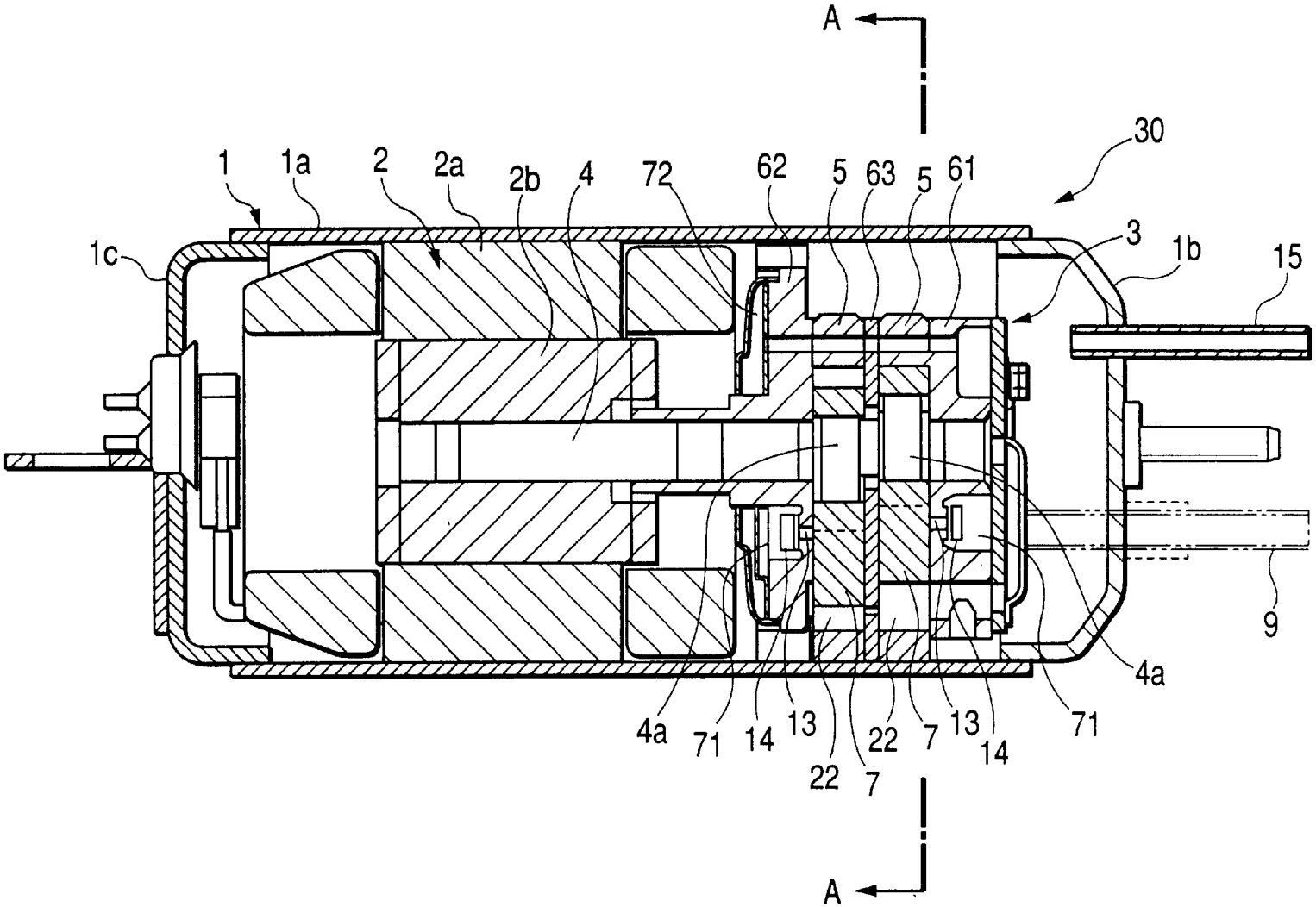
FIG. 1 is a longitudinal sectional view of a first embodiment of a rotary piston compressor according to this invention.

In FIG. 1, a closed vessel 1 is comprised of a long, cylindrical body section 1*a* and cover sections 1*b* and 1*c* on respective ends thereof. In the closed vessel 1 an electric motor section 2, a compression mechanism section 3, and a crankshaft 4 are housed.

The electric motor section 2 has a stator 2*a* and a rotor 2*b*, the stator 2*a* being firmly attached on one side in the closed vessel 1, and the rotor 2*b* being rotatably installed within the stator 2*a*.

Figure 3:
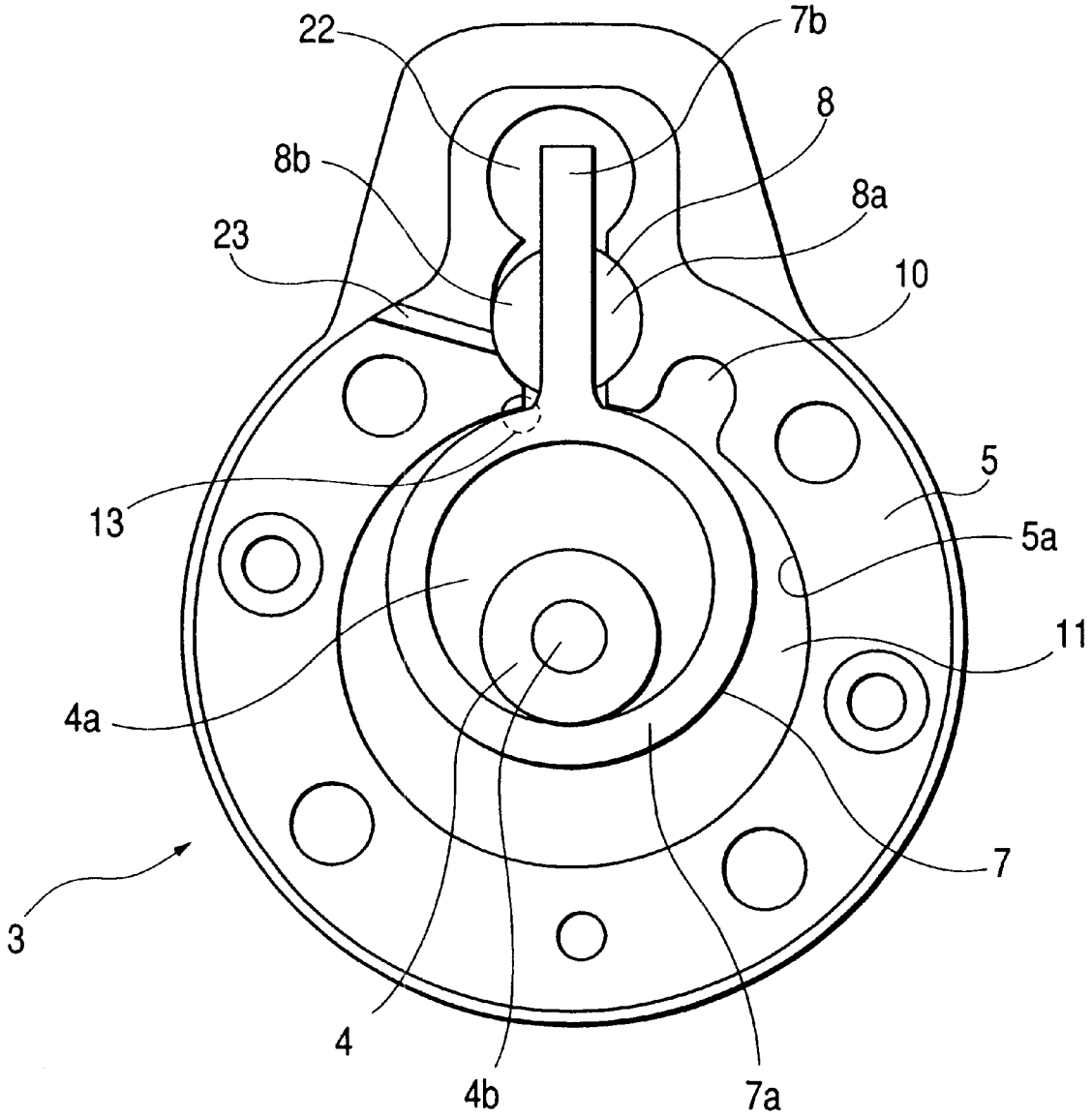
FIG. 3 is a sectional view taken on line A—A of a compression mechanism section of the rotary piston compressor of FIG. 1 during routine operation.

The compression mechanism section 3 has two cylinders 5, end plates 61 and 62 on both sides, an intermediate end plate 63, two pistons 7, and two rotary bushings 8. The piston 7 includes a roller 7*a* and a vane 7*b*, which are formed as one unit, as seen in FIG. 3. The compression mechanism section 3 is secured on the other side inside of the closed vessel 1 through the end plate 61.

Figure 2:
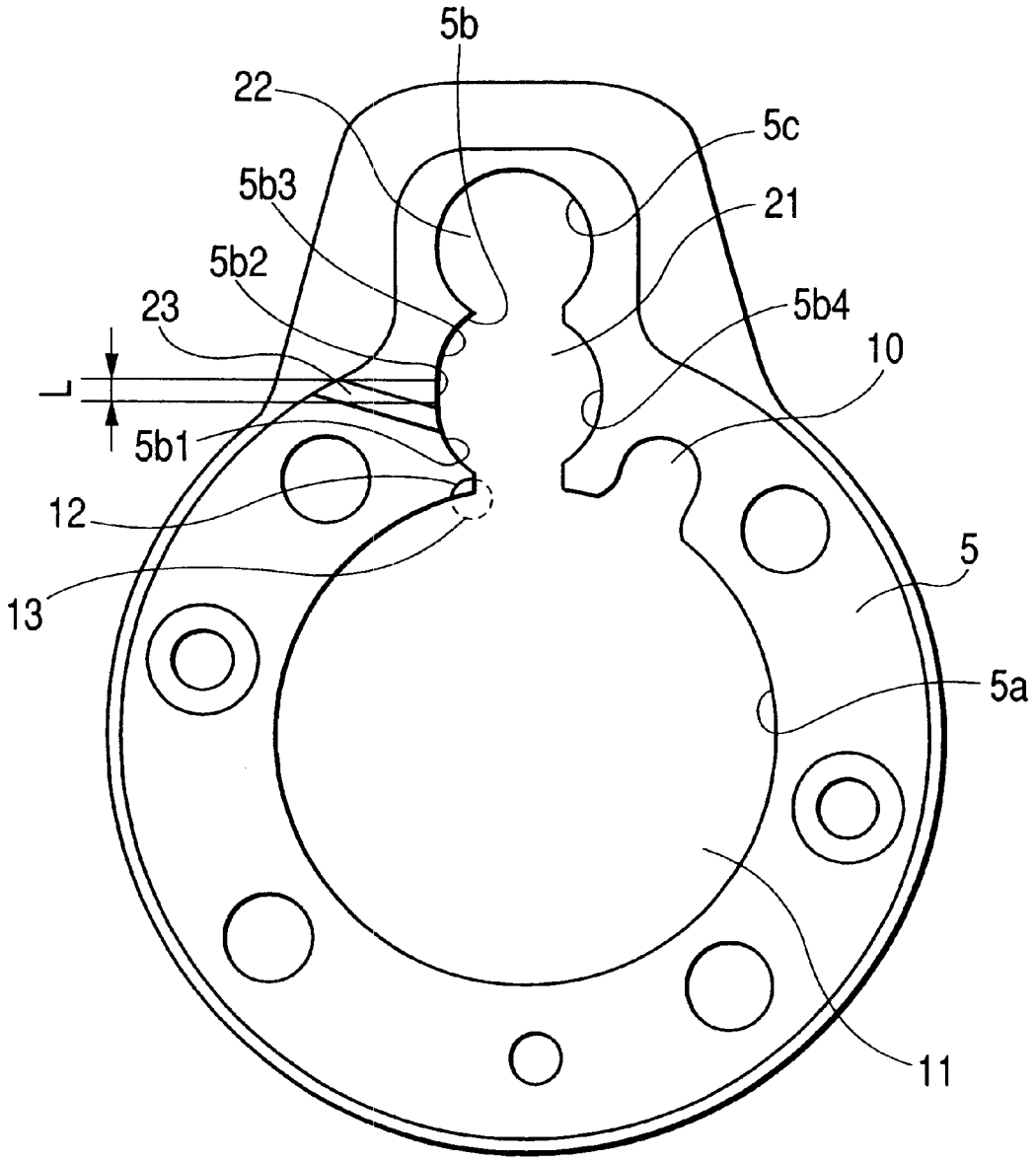
FIG. 2 is a sectional view taken on line A—A of a rotary piston compressor cylinder of FIG. 1.

The two cylinders 5 have a cylindrical inner peripheral surface 5*a*, as seen in FIG. 2. Between the two cylinders the end plate 63 is interposed. The end plates 61 and 62 are disposed on both sides of the two cylinders, thereby forming two spaces as a cylinder chamber 11 surrounded by these end plates 61 and 62. The cylinder 5 is formed adjacent to a cutout suction groove 10 and a cutout discharge groove 12 connected to the cylinder chamber 11. The cutout discharge groove 12 is connected to a discharge port 13 formed in the end plates 61 and 62.

The cylinder 5 is provided with a bushing housing bore 5*b* (5*b*1, 5*b*2, 5*b*3) which forms a bushing housing chamber 21 communicating with the cylinder chamber 11, and, furthermore, with a pump bore 5*c* which forms an oil-supply pump chamber 22 communicating with the bushing housing chamber 21.

Both sides of the bushing housing bore 5*b*, as is clear from FIG. 2, are asymmetrical. The compression chamber side of the bushing housing bore 5*b* is formed of a circular portion 5*b*1 on the cylinder chamber side, a intermediate straight portion 5*b*2, and a circular portion 5*b*3 on the opposite side of the cylinder chamber, as viewed from the vicinity of the cylinder chamber 11. The other suction chamber side is formed to be semicircular. The intermediate straight portion 5*b*3 is formed to a specific size L.

The bushing housing chamber 21 communicates with a high-pressure space in the closed vessel outside of the cylinder 5 through a communicating passage 23. The communicating passage 23 is so formed as to open to one part of the circular portion 5*b*1 on the cylinder chamber side of the bushing housing bore 5*b*. The communicating passage, in the present embodiment, is formed in the cylinder 5, but may be formed in the opposite end plates 61, 62 and 63.

The crankshaft 4 is fixedly attached on one side to the rotor 2*b* of the electric motor section 2 and on the other side to the compression mechanism section 3, being rotatably supported on bearings mounted on the end plates 61 and 62. The crankshaft 4 is provided with two off-center portions 4*a* formed and positioned within two rollers 7*a* of the piston 7. The crankshaft 4 has an oil feed hole 4*b* formed through the central portion thereof The rotor 2*b* rotates as electrical power is supplied to the stator 2*a* of the electric motor 2, thereby turning the crankshaft 4 and, accordingly, eccentrically turning the two off-center portions 4*a* of the crankshaft 4 within the two rollers 7*a*.

Figure 5:
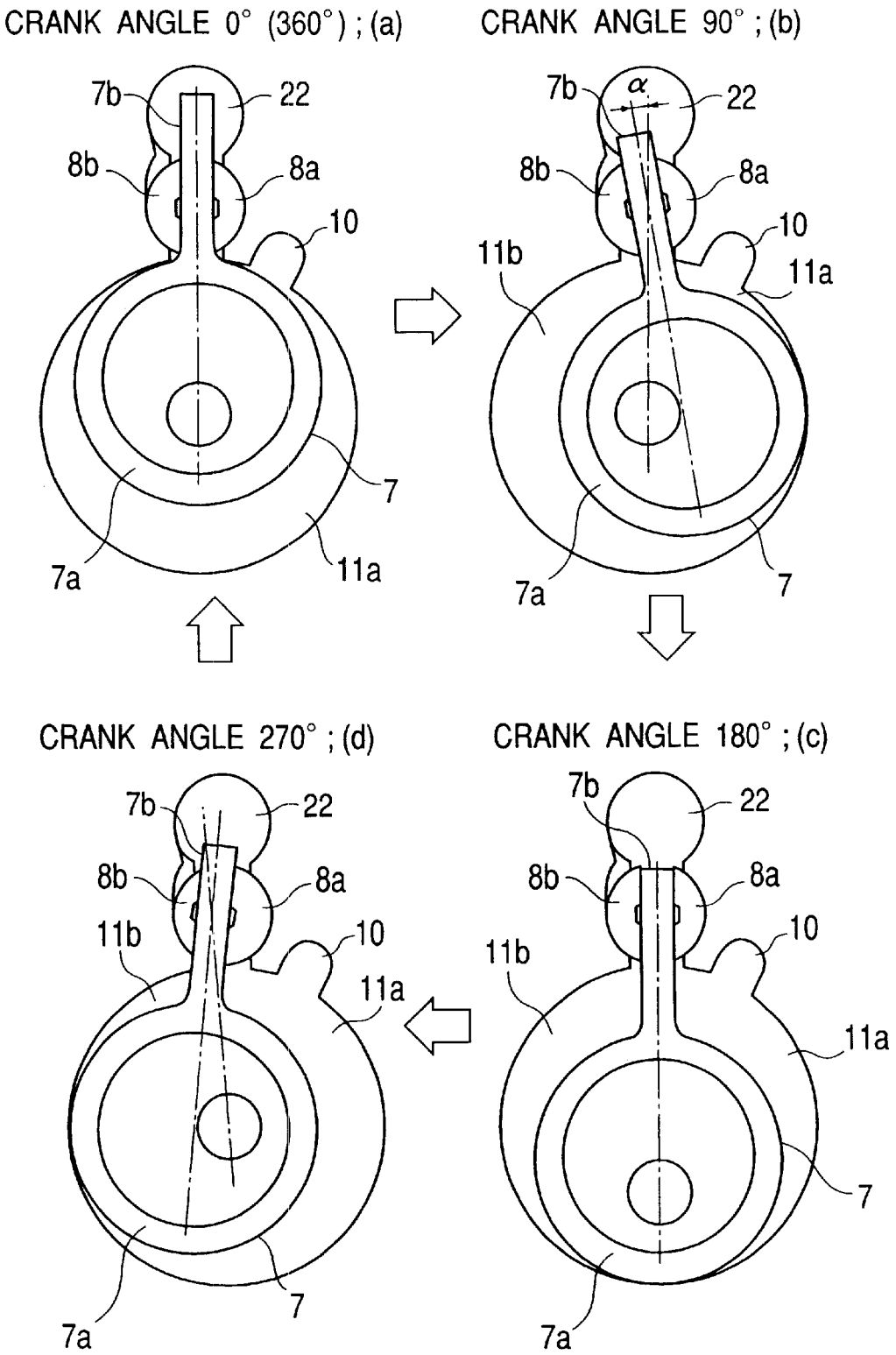
FIG. 5 is an operating flow diagram of the sequence of operation of the rotary piston compressor of FIG. 1.

Thus, the rotor 7*a* rotates within the cylinder 5 as shown in FIG. 5.

The vane 7*b* unitarily formed on the roller 7*a* is supported on the rotary bushing 8 in such a manner that, with the revolution of the roller 7*a* as shown in FIG. 5, it can move back and forth within the cylinder chamber 11 while rotating at the angle of rotation a in relation to the centerline. The vane 7*b* is disposed between the cutout suction groove 10 and the cutout discharge groove 12 so that the cylinder chamber 11 is divided into the suction chamber 11*a* and the compression chamber 11*b*. Furthermore, the vane 7*b* thus disposed is extended from the bushing housing chamber 21 to the oil-supply pump chamber 22.

Figure 4:
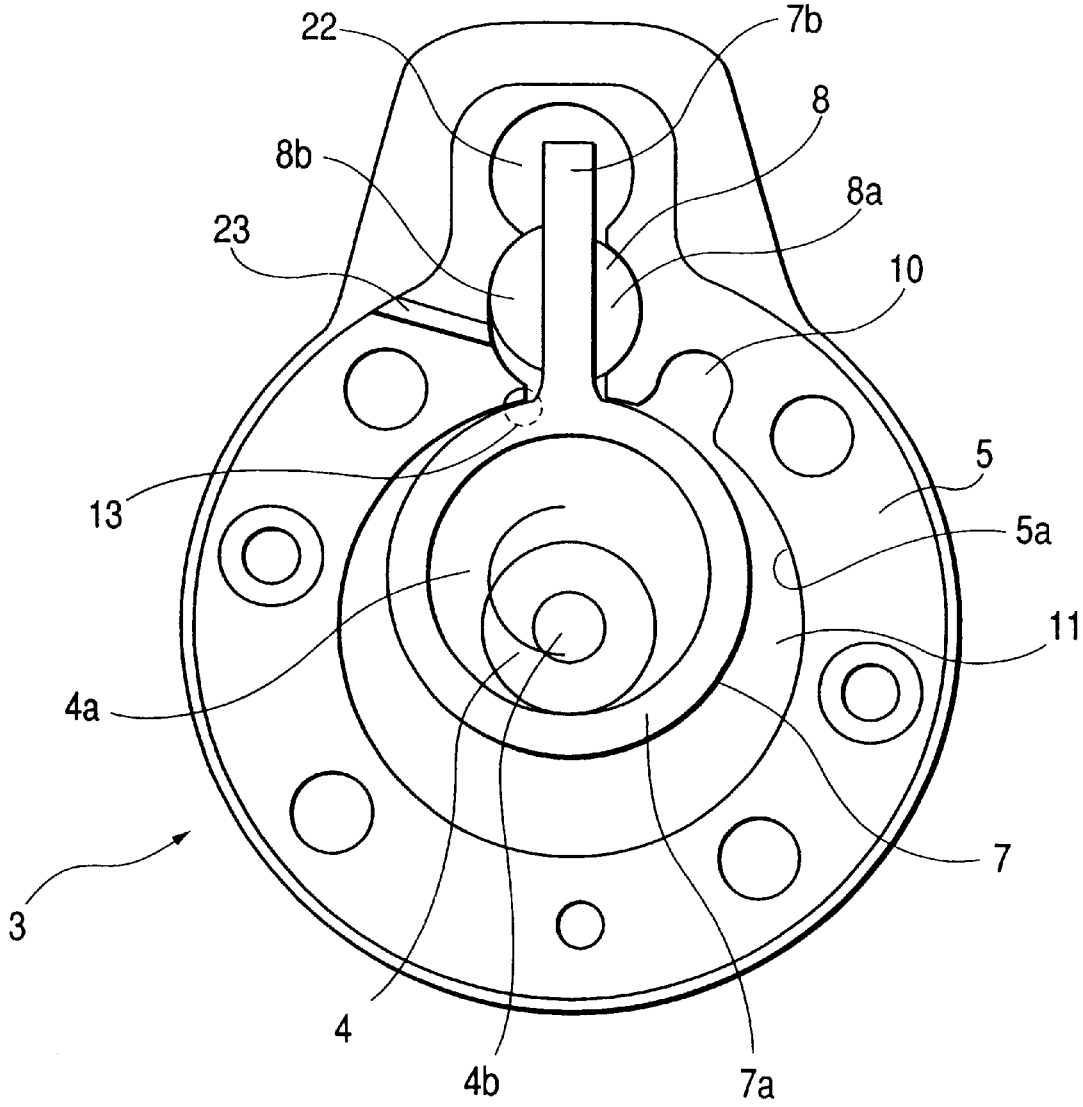
FIG. 4 is a sectional view taken on line A—A of the compression mechanism section of the rotary piston compressor of FIG. 1 during overcompression operation.

As shown in FIGS. 3 and 4, the rotary bushing 8 is separated into a rotary bushing 8*a* on the suction chamber side and a rotary bushing 8*b* on the compression chamber side, which are mounted on both sides of the vane 7*b* in the bushing housing bore 5*b*. These rotary bushings are formed in a semicircular form comprising a semicircular portion and a straight portion. The outside diameter of the semicircular portion of the rotary bushing 8 is a very little smaller than the inside diameter of the circular portion 5*b*1 and the semicircular portion 5*b*4 on the cylinder chamber side of the bushing housing bore 5*b* and, to be more specific, is set to a size which allows the formation of a very narrow clearance for the formation of an oil film between the rotary bushing 8 and the bushing housing bore 5*b*. The rotary bushing 8*b* on the compression chamber side is so arranged as to be movable by the size of the intermediate straight portion 5*b*2. The rotary bushing 8 is mounted in such a manner as to partly face the suction chamber 11*a* and the compression chamber 11*b*.

With the revolution of the roller 7*a* as previously stated, the roller 7*a,* the vane 7*b* and the rotary bushing 8, in the routine operation, change their positions from the state (a) to the state (d) in FIG. 5. Each of these states will be explained. When the crank angle is 0° (360°), the state (a) indicates the beginning of suction and the completion of discharge; that is, at the rotation angle $\alpha$ of 0°, the vane 7*b* is fully withdrawn from the cylinder chamber 11 and fully projects into the oil-supply pump chamber 22. When the roller 7*a* rotates from this state, the volume of the suction chamber 11*a* increases, while the volume of the compression chamber 11*b* decreases. In the state (b) at the crank angle of 90°, the rotation angle $\alpha$ is at a maximum, at which the amount of projection of the vane 7*b* into the cylinder chamber 11 increases and the amount of projection of the vane 7*b* into the oil-supply pump chamber 22 decreases. When the roller 7*b* rotates further from this state until the crank angle becomes 180° into the state (c), the rotation angle $\alpha$ decreases to 0, at which the vane 7*b* fully projects into the cylinder chamber 11 and is fully withdrawn from the oil-supply pump chamber. As the roller 7*a* rotates further from this state to the state (d) at the crank angle of 270°, the rotation angle $\alpha$ reaches a maximum on the opposite side, at which the amount of projection of the vane 7*b* into the cylinder chamber 11 decreases, while the amount of projection into the oil-supply pump chamber 22 increases. The roller 7*a* further rotates from this position, back to the initial state (a), thereafter repeating the above-described operation.

The position of the rotary bushing 8*b* on the compression chamber side is determined by the resultant of load applied to a portion facing the compression chamber 11*b* and the oil-supply pump chamber 22. In a routine operation, the resultant is applied toward the cylinder chamber at all crank angles until the rotary bushing 8*b* is pressed into contact with the circular portion 5*b*1 on the cylinder chamber side, whereby the communicating passage 23 is closed with the rotary bushing 8. The oil-supply pump chamber 21 is located at the lower part within the closed vessel 1, and is extended to the refrigerating machine oil held at the lower part within the closed vessel 1 through a fluid diode. In this oil-supply pump chamber 21, the vane 7*b* rotates in and out as shown in FIG. 5, thereby allowing the refrigerating machine oil to flow from the closed vessel 1 into the oil-supply pump chamber 21 through the fluid diode, and further to be supplied to each sliding part of the compression mechanism section to lubricate the sliding part.

A suction pipe 9 and a discharge pipe 15 are installed through the closed vessel 1, being connected on one side to an external refrigerating cycle. The suction pipe 9 is connected on the other side to a cutout suction groove 10. The discharge pipe 15 is connected on the other side to a high-pressure space in the closed vessel. The refrigerant gas that has been drawn from the suction pipe 9 flows out of the suction portion of the end plates 61 and 62, being drawn into the cylinder chamber 11 through the cutout suction groove 10 of the cylinder 5. The refrigerant thus drawn in is compressed with a change in the volume of the compression chamber 11, as is clear from FIG. 5, then flows through the cutout discharge groove 12 of the cylinder 5 to push up the discharge valve 14 from the discharge port 13 of the end plates 61 and 62, being discharged into the first discharge silencer 71. The high-pressure refrigerant thus discharged passes through the second silencer 72, being discharged into the space in the closed vessel 1. The refrigerant gas in the closed vessel 1 is discharged from the discharge pipe 15 out to the external refrigerating cycle.

Figure 6:
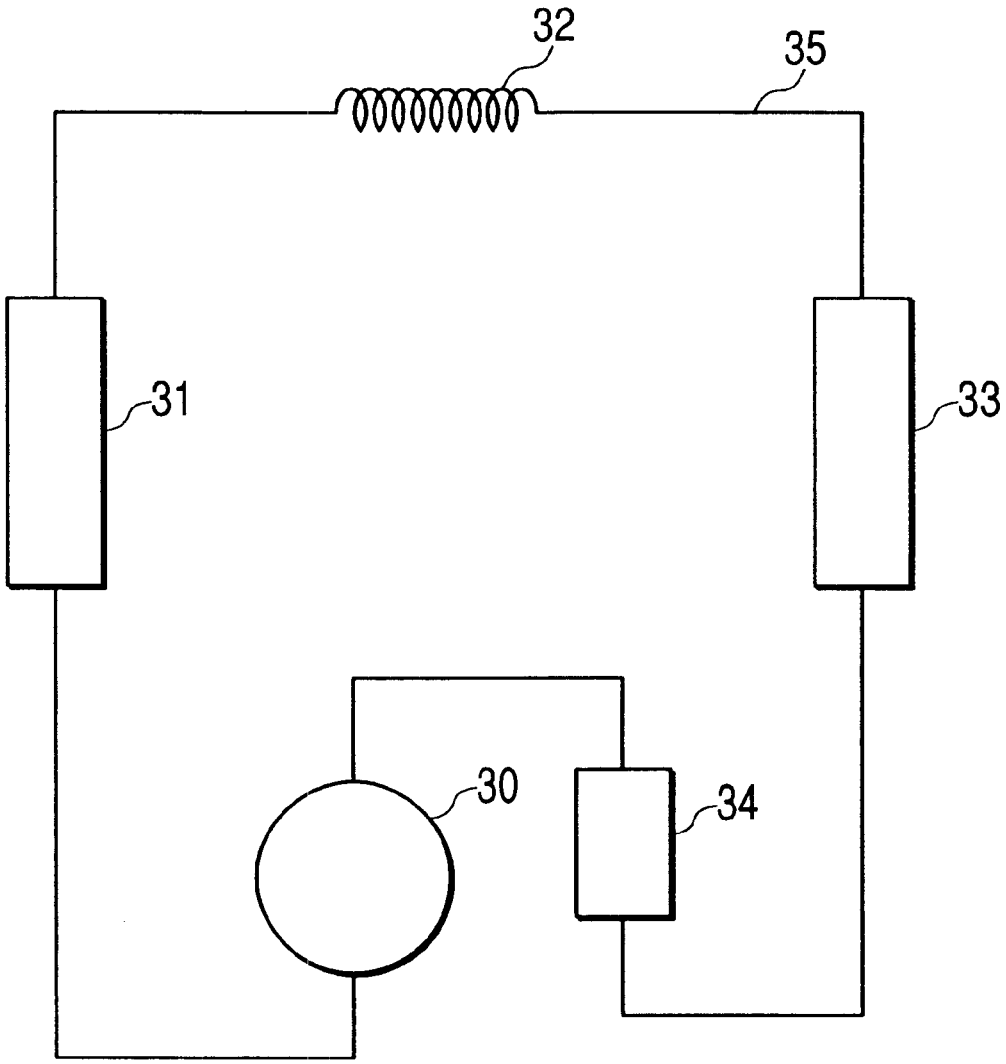
FIG. 6 is a refrigerating cycle diagram of the refrigerating equipment using the rotary piston compressor of FIG. 1.

The refrigerating cycle is comprised of a rotary piston compressor 30, a condenser 31, a pressure reducing device 32 including a capillary tube, an evaporator 33, and a receiver tank 34, which are connected by a piping 35, as shown in FIG. 6. In the present embodiment, the refrigerating equipment using this refrigerating cycle is a refrigerator.

When the refrigerating cycle is operated, the refrigerant in the refrigerating cycle is compressed to a high-pressure gas in the rotary piston compressor 30, from which the high-pressure gas goes into the condenser 31. In the condenser 31 the high-pressure gas is cooled and returned to its liquid state, flowing into the pressure reducing device 32, where the pressure of the liquid refrigerant is reduced to a low pressure. The low-pressure refrigerant reaches the evaporator 33, where the refrigerant is vaporized to draw heat from the surrounding atmosphere, then it goes into the receiver tank 34. The refrigerant, after separation of liquid in the receiver tank 34, returns to the rotary piston compressor 30, thus completing a specific cooling operation.

Then, after the refrigerating cycle operation is stopped, the refrigerant in the evaporator 33 returns to a liquid and is held therein because the evaporator 33 is at a low temperature. Therefore, when the refrigerating cycle operation is restarted, a transient phenomenon takes place such that the liquid refrigerant or the wet refrigerant is drawn into the rotary piston compressor 30 during the starting operation of the rotary piston compressor 30 immediately after restarting.

Operation of the rotary piston compressor 30 during the starting operation will now be explained.

When the rotary piston compressor 30 is started, the rotor 7*a* rotates to draw in the liquid refrigerant or the wet refrigerant, which is subsequently compressed. In the compression process, a low-pressure refrigerant thus drawn in is compressed, thereby increasing the refrigerant pressure in the compression chamber 11*b*. When the pressure of the thus compressed refrigerant has reached the pressure in the space in the closed vessel 1, the discharge valve 14 is opened to connect the compression chamber 11*b* to the space in the closed vessel 1 on the outside of the cylinder 5. Furthermore, in the compression process, the resultant load being applied to the portion facing the oil-supply pump chamber 22 and the compression chamber 11*b* of the rotary bushing 8*b* on the compression chamber side has been set so as to be applied toward the cylinder chamber, so that the rotary bushing 8*b* on the compression chamber side will be pressed into contact with the circular portion 5*b*1 on the cylinder chamber side.

The communicating passage 23, therefore, is closed by the rotary bushing 8*b* on the compression chamber side. When the resultant of the load applied to the portion facing the compression chamber 11*b* of the rotary bushing 8*b* on the compression chamber side and the load applied to the portion facing the oil-supply pump chamber 22 is not less than a specific value, the rotary bushing 8*b* on the compression chamber side moves toward the opposite side of the cylinder chamber. Also, when the resultant of the load has decreased not more than a specific value, the rotary bushing 8*b* on the compression chamber side moves toward the cylinder chamber. It is therefore possible to reliably prevent over-compression by using the pressure of the oil-supply pump chamber 22.

Furthermore, the rotor 7*a* rotates to perform the discharge process. In this case, when the pressure of the compression chamber 11*b* has increased over a specific value, the resultant of load applied to the portion facing the oil-supply pump chamber 22 and the compression chamber 11*b* of the rotary bushing 8*b* on the compression chamber side is so set as to be exerted toward the opposite side of the cylinder chamber. The rotary bushing 8*b* on the compression chamber side is moved into contact with the circular portion 5*b*3 on the opposite side of the cylinder chamber, so that the communicating passage 23 is opened by the rotary bushing 8*b* on the compression chamber side. Therefore, the compression chamber 11*b* communicates with the space in the closed vessel 1 through the communicating passage 23; and, the refrigerant in the compression chamber 11 is discharged into the space in the closed vessel 1 through the communicating passage 23, thereby preventing over-compression which is likely to be caused by the compression of the liquid refrigerant or the wet refrigerant, thereby improving the reliability of the rotary piston compressor.

When the compressor operation returns to the compression stroke after the discharge process, the pressure in the compression chamber 11*b* lowers as low as the suction pressure; therefore, the resultant of load being applied to the portion facing the oil-supply pump chamber 22 and the compression chamber 11*b* of the rotary bushing 8*b* on the compression chamber side is applied toward the cylinder chamber. Thus, the bushing 8*b* on the compression chamber side is pressed into contact with the circular portion 5*b*1 on the cylinder chamber side, to thereby close the communicating passage 23. Therefore, when the operation returns from the discharge stroke to the compression stroke, it is possible to prevent the refrigerant in the space in the closed vessel 1 from returning to the compression chamber 11 through the communicating passage 23 and accordingly to prevent the lowering of the refrigerating capacity.

In the rotary piston compressor 30 described above, the bushing housing bore 5*b* which defines the cylinder chamber 11 is comprised, on the compression chamber side, of the circular portion 5*b*1 on the cylinder chamber side, the intermediate straight portion 5*b*2, and the circular portion 5*b*3 on the opposite side of the cylinder chamber, as viewed from the vicinity of the cylinder chamber 11. Therefore, it is possible to smoothly move the rotary bushing 5*b*3 of a simple shape on the opposite side of the cylinder chamber through the intermediate straight portion 5*b*2.

In the refrigerating equipment using the above-described rotary piston compressor 30 for the refrigeration cycle, the receiver tank 34 can be downsized.

Figure 7:
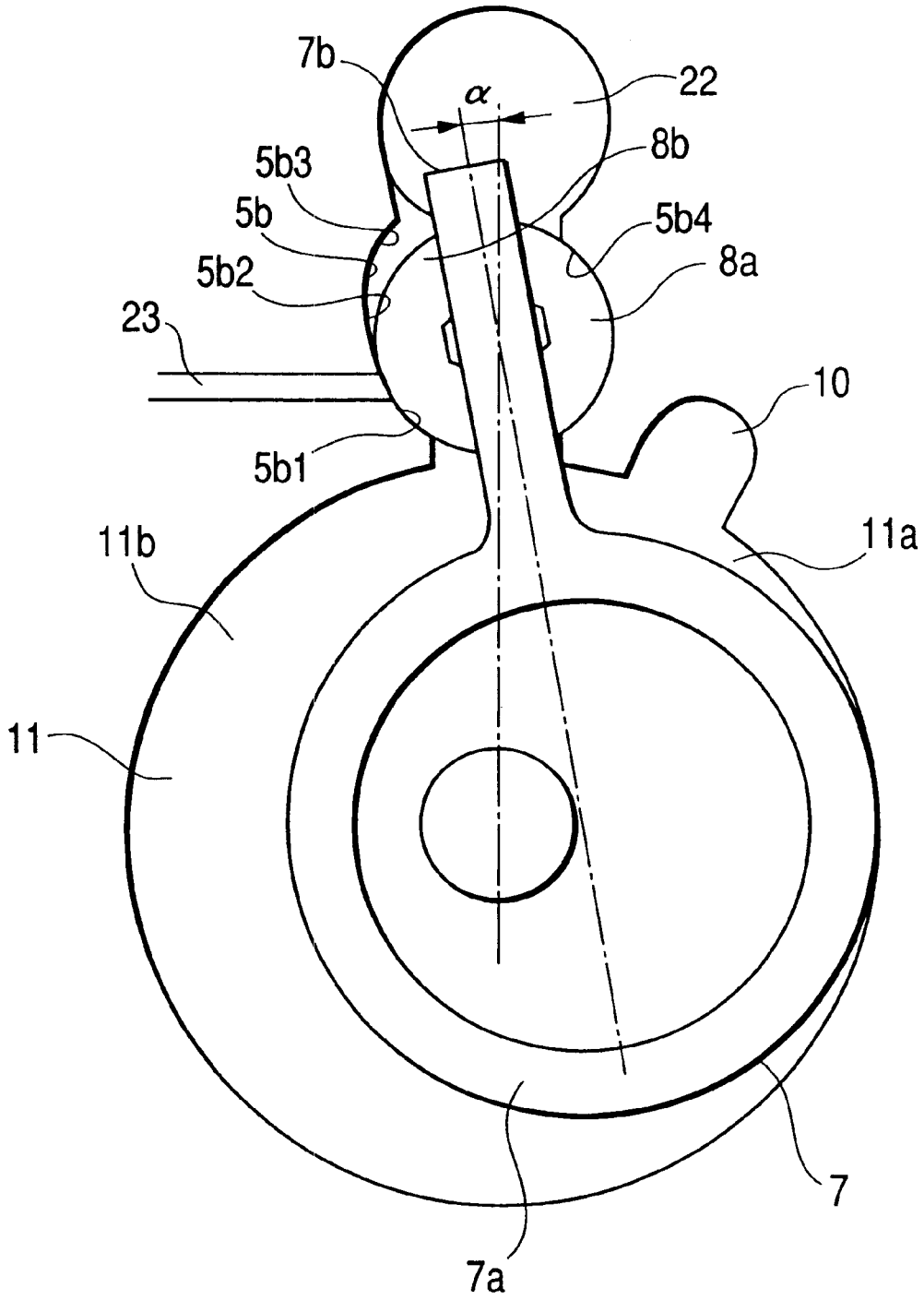
FIG. 7 is a diagram of a second embodiment of the compression mechanism of the rotary piston compressor according to this invention.
Figure 8:
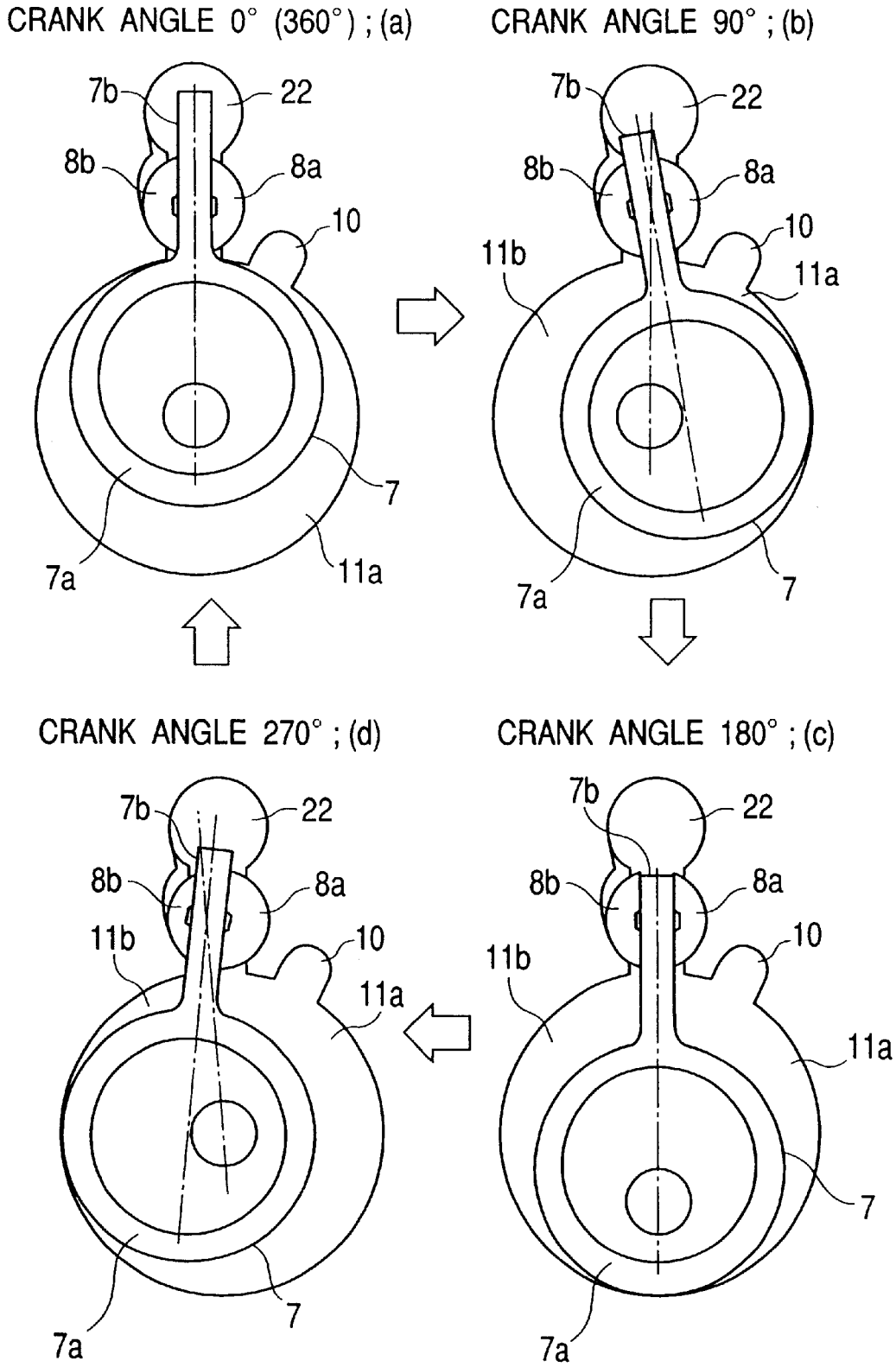
FIG. 8 is an operation flow diagram of the sequence of operation of the rotary piston compressor of FIG. 7.

Next, a second embodiment of this invention will be explained with reference to FIGS. 7 and 8. FIG. 7 is an explanatory view of the compression mechanism section of the rotary piston compressor of the second embodiment according to this invention; and FIG. 8 is an explanatory view of operation of the rotary piston compressor of FIG. 7. In the description of the second embodiment, the configuration of members common to those of the first embodiment will not be described in order to prevent redundancy.

The second embodiment differs from the first embodiment in the respect that, as is clear from FIG. 7, the intermediate straight portion 5*b*2 on the compression chamber side of the bushing housing bore 5*b* is formed to spread outward so as to be approximately parallel with the vane 7*b* at the maximum rotation angle $\alpha$. In other respects, there is no difference between the second embodiment and the first embodiment.

According to the configuration described above in the second embodiment, the rotary piston compressor of the second embodiment has the same advantage as that of the first embodiment, and can be so set as to move the rotary bushing 8*b* on the compression chamber side even at the crank angle of 180° or less.

It should be noticed that, in the above-described embodiment, the rotary bushing 8*b* on the compression chamber side is so configured as to face the oil-supply pump chamber 22, but the invention is not limited thereto.

According to this invention, the rotary bushing of a simple configuration can prevent over-compression of a refrigerant without deteriorating compressor performance during routine operation, and also can prevent re-expansion of the refrigerant after completion of the discharge process. It is therefore possible to provide a high-reliability, high-performance rotary piston compressor and refrigerating equipment.

Furthermore, according to this invention, it is possible to obtain refrigerating equipment incorporating a high-reliability, high-performance rotary piston compressor and a small-sized receiver tank.

What is claimed is:

1. A rotary piston compressor, comprising: a cylinder which forms a cylinder chamber and a bushing housing chamber communicating therewith, a piston disposed in said cylinder chamber, and a rotary bushing disposed in said bushing housing chamber; said piston unitarily having a roller which rotates in said cylinder chamber, and a vane which, together with said roller, divides the interior of said cylinder chamber into a suction chamber and a compression chamber; said vane being extended into said bushing housing chamber; said rotary bushing being separated into a rotary bushing on the compression chamber side and another rotary bushing on the suction chamber side on both sides of said vane; and said rotary bushing on the compression chamber side being disposed so as to move away from said cylinder chamber when a compression chamber pressure not less than a specific pressure, and also to move toward said cylinder chamber when said compression chamber pressure has decreased to not more than a specific pressure, thereby opening and closing a communicating passage for providing communication between said compression chamber and a space on the discharge side outside of said cylinder with the movement of said rotary bushing on the compression chamber side.

2. A rotary piston compressor, comprising: a cylinder which forms a cylinder chamber and a bushing housing chamber communicating therewith, a piston disposed in said cylinder chamber, and a rotary bushing disposed in said bushing housing chamber; said piston unitarily having a roller which rotates in said cylinder chamber, and a vane which, together with said roller, divides the interior of said cylinder chamber into a suction chamber and a compression chamber; said vane being extended into said bushing housing chamber; said rotary bushing being separated into a rotary bushing on the compression chamber side and another rotary bushing on the suction chamber side on both sides of said vane; said rotary bushing on the compression chamber side, having a portion facing said compression chamber and a portion facing the high discharge pressure side, and being arranged to move away from said cylinder chamber when the resultant of load being applied to the portion facing said compression chamber and load being applied to said portion facing said high discharge pressure side is not less than a specific value, and to move toward said cylinder chamber when said resultant has lowered to not more than a specific value, to thereby open and close a communicating passage for providing communication between said compression chamber and a space on the discharge side outside of said cylinder with the movement of said rotary bushing on said compression chamber side.

3. A rotary piston compressor, comprising: a cylinder forming a cylinder chamber, a bushing housing chamber communicating therewith, and a oil-supply pump chamber communicating therewith; a piston arranged in said cylinder chamber; and a rotary bushing arranged in said bushing housing chamber; said oil-supply pump chamber communicating with a high discharge pressure side and a sliding portion; said piston unitarily having a roller revolving in said cylinder chamber, and a vane which, together with said roller, divides the interior of said cylinder chamber into a suction chamber and a compression chamber; said vane being extended from said bushing housing chamber to said oil-supply pump chamber, operating to drive said oil-supply pump chamber as a pump; said rotary bushing being divided into a rotary bushing on the suction chamber side and a rotary bushing on the compression chamber side on both sides of said vane; said rotary bushing on the compression chamber side having a portion facing said compression chamber and a portion facing said oil-supply pump chamber, and moving away from said cylinder chamber when the resultant of load being applied to said portion facing said compression chamber and load being applied to said portion facing said oil-supply pump chamber not less than a specific value, and moving toward said cylinder chamber when said resultant has lowered to not more than a specific value, thereby opening and closing a communicating passage connected between said compression chamber and said space on the discharge side outside of said cylinder with the movement of said rotary bushing on the compression chamber side.

4. A rotary piston compressor, comprising: a cylinder forming a cylinder chamber and a bushing housing chamber communicating therewith, and a rotary bushing arranged in said bushing housing chamber; said piston unitarily having a roller which revolves in said cylinder chamber, and a vane which, together with said roller, the interior of said cylinder chamber into a suction chamber and a compression chamber; said vane being extended into said bushing housing chamber; said bushing housing bore forming said cylinder chamber being comprised of a circular portion on the cylinder chamber side, an intermediate straight portion, and a circular portion on the opposite side of said cylinder chamber, as viewed from the vicinity of said cylinder chamber; said rotary bushing being divided into a rotary bushing on the suction chamber side and a rotary bushing on the compression chamber side on both sides of said vane; said rotary bushing on the compression chamber side having a portion facing said compression chamber and a portion facing the high discharge pressure side, moving away from said cylinder chamber when the resultant of load being applied to said portion facing said compression chamber and load being applied to said portion facing the high discharge pressure side is not less than a specific value, and moving toward said cylinder chamber when the resultant has lowered to not more than a specific value, to thereby open and close a communicating passage for providing communication between said compression chamber and the space on the discharge side outside of said cylinder with the movement of said rotary bushing on the compression chamber side.

5. A rotary piston compressor, comprising: a cylinder which forms a cylinder chamber and a bushing housing chamber communicating therewith, a piston disposed in said cylinder chamber, and a rotary bushing disposed in said bushing housing chamber; said piston unitarily having a roller which rotates in said cylinder chamber, and a vane which, together with said roller, divides the interior of said cylinder chamber into a suction chamber and a compression chamber; said vane being extended into said bushing housing chamber; said bushing housing bore which defines said cylinder chamber, asymmetrically forming a suction chamber side and a compression chamber side; said suction side being formed by a semi-circular portion, and said compression chamber side being comprised of a circular portion on the cylinder chamber side, an intermediate straight portion, and a circular portion on the opposite side of said cylinder chamber, as viewed from the vicinity of said cylinder chamber; said rotary bushing being divided into a rotary bushing on the suction chamber side and a rotary bushing on the compression chamber side on both sides of said vane; said rotary bushing on the suction chamber side having approximately the same outside shape of said semi-circular portion as said semi-circular portion on the suction chamber side of said bushing housing bore; said rotary busing on the compression chamber side having a portion facing said compression chamber and a portion facing the high discharge pressure side, and being so arranged that said rotary bushing will move away from said cylinder chamber when the resultant of load being applied to said portion facing said compression chamber and load being applied to said portion facing said high discharge pressure side is not less than a specific value, and will move toward said cylinder chamber when the resultant has decreased to not more than a specific value, to thereby open and close a communicating passage for providing communication between said compression chamber and the space on the discharge side outside of said cylinder with the movement of said rotary bushing on the compression chamber side.

6. A rotary piston compressor, comprising: a cylinder which forms a cylinder chamber and a bushing housing chamber communicating therewith, a piston disposed in said cylinder chamber, and a rotary bushing disposed in said bushing housing chamber; said piston unitarily having a roller which rotates in said cylinder chamber, and a vane which, together with said roller, divides the interior of said cylinder chamber into a suction chamber and a compression chamber; said vane being extended into said bushing housing chamber; the compression chamber side of said bushing housing bore which defines said cylinder chamber, being comprised of a circular portion on the cylinder chamber side, an intermediate straight portion, and a circular portion on the opposite side of said cylinder chamber, as viewed from the vicinity of said cylinder chamber; said intermediate straight portion being spread outward; said rotary bushing arranged being divided to a rotary bushing on the suction chamber side and a rotary bushing on the compression chamber side on both sides of said vane; said rotary bushing on the compression chamber side having a portion facing said compression chamber and a portion facing the high discharge pressure side, so that said rotary bushing will move away from said cylinder chamber when the resultant of load being applied to the portion facing said compression chamber and load being applied to the portion facing said high discharge pressure side is not less than a specific value, and will move toward said cylinder chamber when the resultant has decreased to not more than a specific value, thereby opening and closing a communicating passage for providing communication between said compression chamber and the space on the discharge side outside of said cylinder with the movement of said rotary bushing on said compression chamber.

7. A rotary piston compressor, comprising: a cylinder which forms a cylinder chamber and a bushing housing chamber communicating therewith, a piston disposed in said cylinder chamber, and a rotary bushing disposed in said bushing housing chamber; said piston unitarily having a roller which rotates in said cylinder chamber, and a vane which, together with said roller, divides the interior of said cylinder chamber into a suction chamber and a compression chamber; said vane being extended into said bushing housing chamber; said rotary bushing being divided into a rotary bushing on the suction chamber side and a rotary bushing on the compression chamber side on both sides of said vane; said rotary bushing on the compression chamber side being so arranged as to move away from said cylinder chamber when the compression chamber pressure is not less than a specific value in the discharge process of said compressor, and to move toward said cylinder chamber when the compression chamber pressure has decreased to not more than a specific value after the completion of the discharge process of said compressor, thereby opening and closing a communicating passage for providing communication between said compression chamber and the space on the discharge side outside of said cylinder with the movement of said rotary bushing on the compression chamber side.

* * * * *